US005316054A

United States Patent [19]

Hall et al.

[11] Patent Number: 5,316,054

[45] Date of Patent: May 31, 1994

[54] SELF-CONTAINED PACKAGE FOR HOUSING, DISPENSING AND DILUTING CONCENTRATED LIQUID

[75] Inventors: William G. Hall; Robert S. Dirksing, both of Cincinnati, Ohio

[73] Assignee: The Procter & Gamble Company, Cincinnati, Ohio

[21] Appl. No.: 56,215

[22] Filed: Apr. 30, 1993

[51] Int. Cl.[5] ..... B65B 1/04; B65B 3/04; B65B 31/00

[52] U.S. Cl. ..... 141/22; 141/319; 215/228; 215/354; 215/DIG. 7; 215/DIG. 8; 222/545

[58] Field of Search ..... 215/228, 227, 230, 354, 215/DIG. 7, DIG. 8, DIG. 3, 211-214; 141/319, 320, 321, 322, 22; 222/546, 545, 570; 220/212, 288, 306, 307, 377

[56] References Cited

U.S. PATENT DOCUMENTS

| | | | |
|---|---|---|---|
| 518,530 | 4/1894 | McAlpin | 220/212 |
| 1,419,580 | 6/1922 | Molinari | 215/230 |
| 1,986,741 | 1/1935 | Moser | 215/230 |
| 2,543,427 | 2/1951 | Warne | 222/115 |
| 2,804,103 | 8/1957 | Wall | 215/DIG. 7 |
| 3,318,496 | 5/1967 | Ayotte et al. | 222/546 |
| 3,704,819 | 12/1972 | Lindstrom | 222/546 |
| 4,416,381 | 11/1983 | Swartwout | 215/228 |
| 4,427,138 | 1/1984 | Heinlein | 222/546 |
| 4,705,181 | 11/1987 | Burke et al. | 215/213 |
| 4,834,251 | 5/1989 | Yu | 215/DIG. 7 |
| 5,078,289 | 1/1992 | Bolton et al. | 215/228 |

*Primary Examiner*—Henry J. Recla
*Assistant Examiner*—Steven O. Douglas
*Attorney, Agent, or Firm*—E. Kelly Linman; Kevin C. Johnson; Ronald W. Kock

[57] ABSTRACT

A self-contained package for housing, dispensing and diluting concentrated liquid with a predetermined quantity of dilution liquid prior to use. The package comprises a container for housing the concentrated liquid, a spout having a discharge orifice, and a closure. The spout aids the user in controlling the flow of liquid from the container during the dispensing cycle. The closure includes a concentrate reservoir for receiving concentrated liquid from the container and a main body portion for receiving dilution liquid after the concentrate reservoir has been filled with the concentrated liquid. The main body portion of the closure has a cross-section which is larger than the cross-section of the concentrate reservoir to facilitate easy visual sighting when the concentrate reservoir is filled. The concentrate reservoir further includes a centrally located sealing post which penetrates the discharge orifice in the spout to form a liquid tight seal whenever the closure is fully assembled onto the container.

8 Claims, 7 Drawing Sheets

SELF-CONTAINED PACKAGE FOR HOUSING, DISPENSING AND DILUTING CONCENTRATED LIQUID

TECHNICAL FIELD

The present invention relates generally to self-contained packages employing dispensing closures for use with containers intended to house concentrated liquids which are diluted with a predetermined quantity of water or other liquid each time they are used.

BACKGROUND OF THE INVENTION

When dispensing certain types of concentrated liquids, such as concentrated mouthrinses, from containers it is critically important that one be able to get the correct amount and concentration of active, flavor and other ingredients with each diluted dose. For example, some concentrated antimicrobial mouthrinse formulations require proper dilution to provide positive therapeutic plaque and gingivitis prevention benefits. Proper dilution requires the ability to accurately measure both the concentrated mouthrinse from the container, typically a bottle, and the dilution water from the tap or other water source.

For concentrated mouthrinses which are intended to provide therapeutic effects, such as prevention of plaque or gingivitis, patient compliance, i.e., the use of proper regimen, dosage and concentration, is also essential to the efficacy of the mouthrinse.

It is well known that patient compliance is adversely affected by increased difficulty in using a mouthrinse, particularly a concentrated one, which must be diluted each time it is used. Also, the ongoing quality and efficacy of a concentrated mouthrinse requires that it remain substantially free from contamination from germs and saliva from the mouths of users, or contamination from germs and foreign material from the air surrounding the package both before and after the package has been placed in service by the user.

In addition, some concentrated antimicrobial mouthrinse formulations work on the principle that when water is added, a stable organic and water solution transforms into a dispersion of tiny oil droplets within an aqueous phase. This is supposed to occur just prior to use. If water is introduced unintentionally into the concentrated mouthrinse in the bottle prior to use, the shelf stable, homogenous concentrated mouthrinse remaining in the container can be transformed into a mixture which will be unstable, ineffective and unappealing to the user before the next use cycle.

One prior art dispensing system for concentrated mouthrinses, most widely used in Germany, comprises a bottle, with or without a reducing orifice at its point of liquid discharge, that does not employ a closure which can serve as a dilution and use vessel. This design leaves it up to the consumer to use a separate cup or glass, and to either estimate by experience or to use an external measuring device to get the correct amounts of concentrated mouthrinse and dilution water based upon written instructions provided on the package. This approach is ambiguous to consumers, and they often do not get the recommended dose/concentration of diluted mouthrinse. It can also prove awkward in travel situations, since it requires the consumer to have a cup or glass of their own, and such a utensil may not be readily available.

A second approach, which has been practiced in the U.S., employs a flip-up cap on a bottle, with a snap-on dose cup that attaches to the bottle over the top of the flip-up cap. The dose cup has a concentrate line and a water line on it. This particular prior art design has three major drawbacks: 1) it is very difficult to get the correct amount of concentrate because the cup exhibits a relatively large cross-section along its entire vertical axis (this is necessary in order for it to fit over the flip-up cap) resulting in the concentrate fill line being very near the bottom of the cup and consequently very hard to visually sight through; 2) the dose cup is easily lost by the consumer, leaving the consumer without a way to accurately measure the correct concentrate dose or the proper volume of dilution liquid; and 3) the consumer must open the flip-up cap after the dose cup is removed, which represents an extra step which is made more difficult when the dose cup is in one hand and the bottle is in the other. In addition to the foregoing drawbacks, the flip-up cap also requires the consumer to place his or her fingers on or near the product discharge orifice in the flip-up cap in order to initiate the concentrate dispensing process. This could, of course, be unsanitary.

Another prior art package design used on a Japanese concentrated mouthrinse product differs from the prior art package used in Germany in that it employs a V-shaped well at the bottom of the dose cup for measuring the mouthrinse concentrate, and the water dilution line is marked by an inflection of the cup shape. The shape of the dose cup is generally rectangular with radiused corners, which is not ideal for instantaneous mixing of the concentrate with dilution liquid when the liquid is added to the cup. More importantly, this Japanese design requires the user to remove the outer dose cup and then unscrew a sealing cap before dispensing of the mouthrinse concentrate can be carried out. Thus the user must either handle three separate components, i.e., the dose cup, the sealing cap and the container, with only two hands or set one of the components down before proceeding to dispense concentrate from the container. This is awkward.

In addition to the foregoing prior art market place approaches which are used specifically for concentrated mouthrinses, there are a number of prior art patents which generally disclose other approaches to dispensing and measuring liquids from containers. However, the majority of these prior art patents do not address the specific needs of dispensing a concentrated liquid, such as a mouthrinse, to be diluted accurately, yet easily and quickly in conjunction with the problem of maintaining product integrity/stability between successive use cycles.

In this regard, U.S. Pat. No. 4,416,381 issued to Swartout on Nov. 22, 1983 discloses a bottle cap forming an integral measuring cup and bottle closure. The cup has graduations for measuring different amounts of liquid from the bottle. However, because the closure is used merely for measurement and not for dilution, there is no concentrate reservoir of smaller cross-section for accurately measuring a liquid concentrate to be diluted within the measuring cup, nor does the package include a limited cross-section spout to provide flow control, which is very important when measuring small quantities of concentrated liquid. What's more, most of the package embodiments disclosed by Swartout expose the measuring cup portion of the closure to the surrounding atmosphere before and after the package is placed in service, thereby permitting contamination of the measuring cup portion of the closure before and after the package is placed in service by the user.

U.S. Pat. No. 2,543,427 issued to Warne on Feb. 27, 1951 also discloses a combined closure cap/measuring cup. Like Swartout, the measuring cup of Warne is not used for dilution purposes. Furthermore, like most of the embodiments disclosed by Swartout, Warne places the measuring cup in an upright and exposed position when the closure is used to seal the bottle. Thus the measuring cup portion of the closure is exposed to contamination from the surrounding atmosphere and environment not only before the package is placed in service, but also between use cycles after the package has been placed in service by the user. This is highly undesirable for an ethical care product, such as a concentrated mouthrinse.

OBJECTS OF THE INVENTION

A primary object of the present invention is to provide a self-contained package which will enable the accurate, quick and easy dosing of a highly concentrated liquid, such as a mouthrinse, which must be diluted with water by a ratio of at least two-to-one.

Another object of the present invention is to protect the contents of the package by protecting the liquid contacting surfaces of the closure from the surrounding atmosphere both prior to placing of the package in service and between successive use cycles.

Still another object of the present invention is to provide such a closure which will encourage reapplication of the closure to the container by the user after each dispensing cycle, while at the same time substantially preventing contamination of the contents of the bulk package by any residue remaining in the dosing cup after a dispensing, dilution and use cycle.

DISCLOSURE OF THE INVENTION

The foregoing objects are achieved in accordance with the present invention by providing a package employing a closure and spout combination in a container for the liquid concentrate. The closure portion of the present invention serves as both a sealing closure and as a measuring/dilution or dose cup to allow quick and accurate measurement of a concentrated liquid, such as a mouthrinse, as well as quick and accurate measurement of the diluting liquid to be added thereto. The concentrated liquid is preferably colored to enhance the user's ability to measure the proper quantity of concentrate to be diluted. The closure of the present invention is also preferably translucent or transparent to facilitate easier visual measurements of both concentrate and dilution liquid.

The closure includes a concentrate reservoir located at the end of the main body portion of the dose cup. The concentrate reservoir is smaller in cross-section than the main body portion of the dose cup to provide accurate, easily visible measurement of the relatively small volumes of the concentrated liquid to be dispensed.

The concentrate reservoir in a preferred embodiment of the present invention is thimble-shaped, defined by tapered walls like those of a cone, but preferably with a rounded bottom. At the transition point between the concentrate reservoir and main dose cup portion, there is preferably formed a shoulder which serves as a fill line indicator for easy sighting of the correct dose of concentrated liquid, even when sighting downwardly into the closure from overhead. When the closure is made of a translucent or transparent material, such as molded plastic, the correct dose of concentrated liquid is also easily sighted from outside of the closure, as the concentrate reservoir and transition shoulder are also distinctly visible when viewing the closure from its side profile.

At the bottom of the concentrate reservoir there is preferably provided a sealing post which mates with a discharge orifice in the spout portion of packages of the present invention. The shape of the concentrate reservoir, in combination with the sealing post, promotes mixing of the concentrate with the diluting liquid when the diluting liquid is added. A fill line for the diluted liquid which is distinctly visible to the user is preferably provided in the uppermost portion of the closure. This fill line typically comprises an embossed or recessed groove or an inflection created by a change in the closure's diameter or other cross-section.

The spout portion of the present invention normally fits on top of the container, which is typically a resiliently deformable bottle, effectively reducing the size of the container's discharge orifice. The spout portion also typically includes a skirt portion extending through the container's discharge orifice and into the neck of the bottle, said skirt having a seat which fits in sealed relation to the discharge orifice of the bottle.

In a preferred embodiment, the spout further includes a cone-shaped portion extending up from the bottle's discharge orifice and terminating at a discharge orifice which is much smaller than that of the bottle. In a particularly preferred embodiment, there is a short tube extending down toward the bottle from the spout's discharge orifice to reduce the tendency of liquid to spurt out of the orifice when the package is inverted to dispense liquid. Because the discharge orifice of the spout is much smaller than the discharge orifice of the bottle, it limits the flow of concentrated liquid from the bottle, thus providing more precise flow control to the user. The discharge orifice in the spout forms a secure liquid tight seal when contacted or, in a particularly preferred embodiment, penetrated by the sealing post located inside the concentrate reservoir of the closure as the closure is fully assembled onto the container.

When the closure and spout are both fully assembled onto a container of the present invention, the closure fully encloses the spout portion, thereby substantially preventing contamination of the spout and the interior surfaces of the closure from the surrounding atmosphere and environment.

The sealing arrangement between the discharge orifice of the spout and the sealing post portion of the closure of the present invention also substantially eliminates the chance of detrimental back contamination of the concentrated liquid remaining in the container by leftover contents in the closure after a dispensing, dilution and use cycle. This is normally very important to the continued integrity and effectiveness of the unused concentrate remaining in the container after a use cycle.

In one preferred embodiment of the present invention, the rounded bottom of the concentrate reservoir forms the bottom of the closure, making it intentionally inconvenient to set the closure down on a flat surface such as a typical countertop. This discourages leaving the closure off the bottle between successive use cycles, thereby further protecting the concentrate liquid in the bottle between successive use cycles.

In two alternative embodiments of the present invention where having the ability to set the filled closure on a flat surface is a desired feature the closure is provided with a base portion which will allow it to be set down on a flat surface without risk of the closure turning over. In one of these embodiments, supporting ribs extending radially outwardly from the concentrate reservoir are employed. In a second embodiment, a concentrically positioned ring support extends downwardly from the main body portion of the closure about the concentrate reservoir.

BRIEF DESCRIPTION OF THE DRAWINGS

While the specification concludes with claims that particularly point out and distinctly claim the subject matter regarded as forming the present invention, it is believed that the invention will be better understood from the following detailed description with reference to the drawings in which:

DESCRIPTION OF THE PREFERRED EMBODIMENTS

Figure 1:
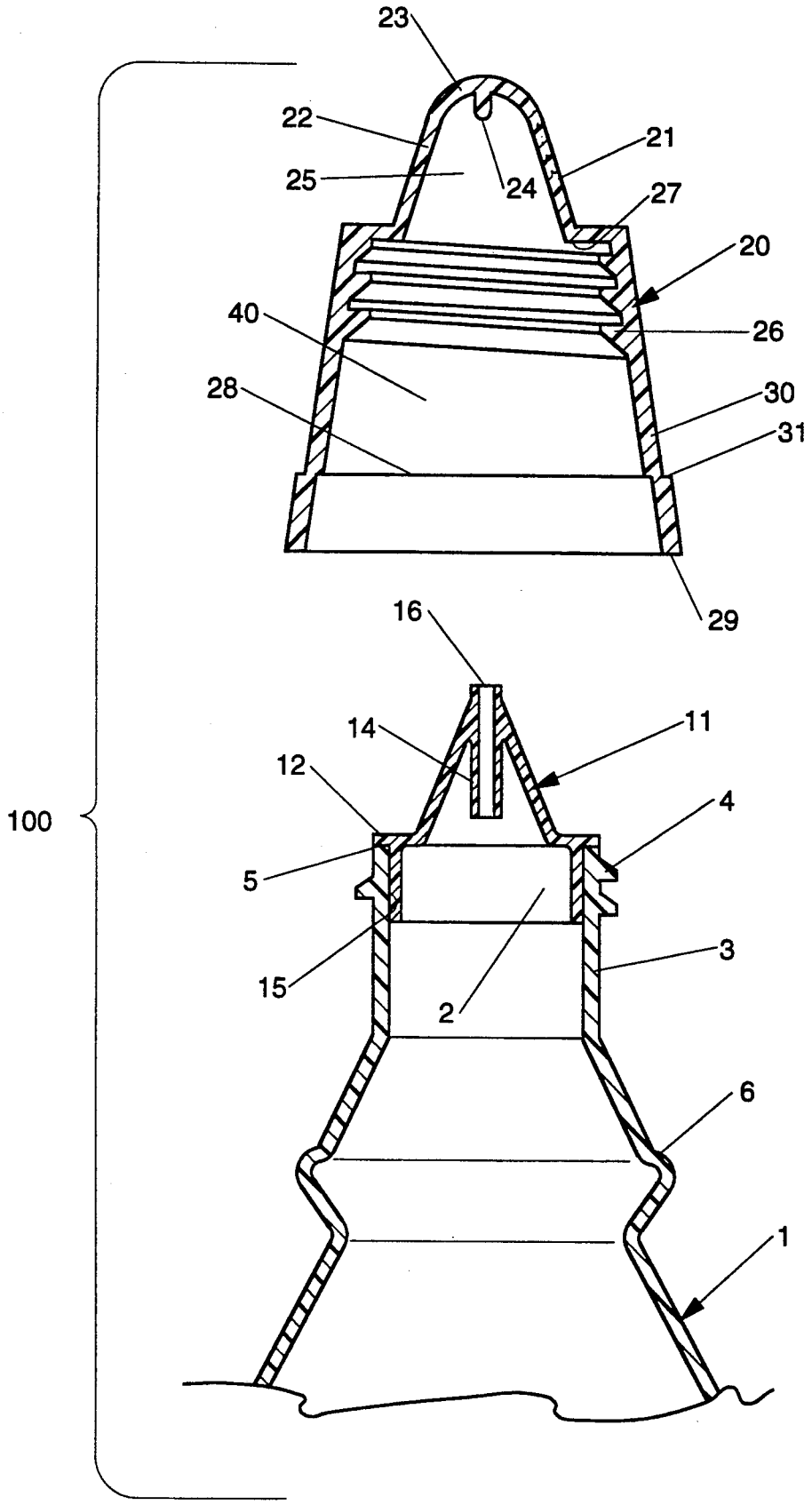
FIG. 1 shows the uppermost portion of a container having a closure and spout insert according to the invention in a partially exploded sectional view.

In FIG. 1, a portion of an exemplary package embodiment 100 of the present invention is shown in cross-section in a partially exploded condition. Package 100 comprises a spout 11, which is sealingly secured across the discharge orifice or mouth 2 of the neck 3 of container 1. Container 1 preferably comprises a resiliently deformable bottle. The container 1 may, if desired, have an external thread 4 on the exterior of its neck 3. Closure 20 preferably includes an internal thread 26 which is complementary to and which mates with external thread 4 on container 100 when the closure is applied to the container. Closure 20 also includes a main body portion 30 and a concentrate reservoir 25, which further includes a centrally located sealing post 24. Sealing post 24 provides a liquid tight seal when it contacts, and preferably penetrates, the discharge orifice 16 provided in spout 11. A liquid tight seal is also formed at the point where spout flange 12 meets concentrate reservoir shoulder 27 on closure 20 when closure 20 is fully assembled onto container 1.

The sealing flange 12 on spout 11 at least partially covers the rim 5 of the container 1. The spout 11 further includes a skirt 15 which extends through the discharge orifice 2 and down into the neck 3 of the container 1, preferably forming a liquid tight circumferential seal between the outside edge of skirt 15 and the inside surface of container neck 3.

The discharge orifice 16 of spout 11 preferably has a much smaller diameter than that of the discharge orifice 2 of container 1, thereby restricting the flow of concentrated liquid (not shown) from the container during dispensing. This provides the user with excellent flow control. Since the container 1 is preferably resiliently deformable, the container is typically manually deformed by squeezing to force concentrated liquid (not shown) through the discharge orifice 16 in spout 11 during the concentrate dispensing cycle. In the embodiment of FIG. 1, an internally positioned tube 14 having the same internal diameter as discharge orifice 16 preferably extends down toward container 1 from the uppermost end of spout 11. This serves to prevent uncontrolled spurting of concentrated liquid out of the discharge orifice 16 when the container 1 is inverted and/or squeezed to initiate dispensing.

Closure 20 serves as a sealing closure when container 1 is not in use and, when removed and inverted, a measuring and dilution cup to allow quick and accurate measurement of both the concentrated liquid dispensed from container 1 and a dilution liquid, such as water, which must be added thereto.

In the preferred embodiment illustrated in FIG. 1, the concentrate reservoir 21 is shaped like a thimble, with tapering sides 22 and a rounded bottom 23. This shape, combined with the centrally located sealing post 24, promotes mixing of the concentrated liquid and the dilution liquid as the dilution liquid is added, as from a water tap. The concentrate reservoir shoulder 27 transitions the larger diameter of the main body portion 30 of the closure 20 with the smaller cross-sectional diameter of the concentrate reservoir 21. The shoulder 27 can also serve as the fill line for the concentrated liquid, since it is easily sighted when looking down into the closure from overhead. If the closure 20 is made of translucent or transparent plastic, it is also easy to sight from the side profile of the closure when the concentrate reservoir 21 becomes filled, particularly if the concentrated liquid is colored.

In the preferred embodiment illustrated in FIG. 1, the fill line 28 for the diluted liquid is indicated by a stepwise increase in the diameter of the closure, also making it easy to sight from any angle.

As pointed out earlier herein, closure 20 preferably includes an internal thread 26 designed to mate with external thread 4 on the neck 3 of container 1. When closure 20 is screwed onto container 1, a liquid tight seal is preferably formed at two locations. The first such seal is formed where sealing post 24 contacts, and preferably penetrates, the discharge orifice 16 on spout 11. When sealing post 24 penetrates discharge orifice 16, it is relatively insensitive to the degree of penetration needed to establish a liquid tight seal. The post 24 is preferably sized to exhibit a maximum dimension which, at its tip, is slightly smaller than the minimum dimension of discharge orifice 16. This facilitates easy initial insertion when the closure 20 is first applied to the container. However, the central post 24 preferably exhibits a minimum dimension which is slightly greater than the maximum dimension of discharge orifice 16 at the point when closure 20 is fully assembled onto container 1. This ensures that discharge orifice 16 will be blocked in a liquid tight manner by post 24. If desired, post 24 can exhibit a slight taper so that it increases slightly in diameter from its outermost tip in the direction of its base. Because spout 11 and post 24 are both preferably comprised of polymers which are, at least to a degree, resilient, discharge orifice 16 will normally expand, as required, to permit closure 20 to be fully screwed onto container 1 until such time as concentrate reservoir shoulder 27 meets spout sealing flange 12, thereby forming a second liquid tight seal.

When the closure 20 is fully applied to container 1, the closure's uppermost lip 29 nearly touches the container's inflection point 6. This allows air drying of residue within the main body portion 30 of closure 20 without allowing foreign material from the surrounding atmosphere and environment to contaminate the innermost surfaces of concentrate reservoir 21.

The contained volume 25 of concentrate reservoir 21 and the contained volume 40 of the main body portion 30 of the closure 20 are determined in advance based upon the desired dilution ratio of the liquid concentrate housed in container 1. In an exemplary embodiment of the type generally shown in FIG. 1, the volume 25 of the concentrate reservoir is about 3 milliliters, while the volume of the main body portion 40 of the closure 1 between shoulder 27 and shoulder 28 is about 15 milliliters. This provides a dilution ratio of five parts dilution liquid, typically water, to one part liquid concentrate.

In the foregoing exemplary embodiment, the diameter of container 1, as measured across the outermost portion of external thread 4 is about 28 millimeters. The total height of the closure 20, including concentrate reservoir 21, is about 57 millimeters, and the outside diameter of the closure tapers outwardly from about 32 millimeters, as measured at shoulder 27 to about 40 millimeters, as measured at the closure's uppermost lip 29. The height of the concentrate reservoir 21 is about 22 millimeters, and its diameter is about 19 millimeters, as measured at the top of the reservoir, i.e., at shoulder 27. The sealing post 24 exhibits a diameter of approximately 2.5–3 millimeters at its base, tapering to approximately 2 millimeters at its tip and an overall height of approximately 6 millimeters. Spout 11 includes a discharge orifice 16 measuring approximately 2 millimeters in diameter and the tip of the spout is approximately 21 millimeters above the rim 5 of container 1. When closure 20 is fully assembled onto container 1, sealing post 24 penetrates the discharge orifice 16 in spout 11 by a distance on the order of 4–6 millimeters. The overall length of tube 14 is approximately 18 millimeters.

In the foregoing exemplary embodiment, the closure 20 was injection molded from clarified polypropylene, the spout 11 was injection molded from high density polyethylene which was colored with a food grade green pigment, and the container 1 was in the form of a resiliently deformable bottle which was stretch blow molded from polyethylene terephthalate, said bottle having a liquid capacity of approximately 175 millimeters.

The foregoing exemplary embodiment functioned effectively when used to dispense a concentrated mouthrinse, dilute it with tap water in a 5 to 1 ratio and gargle with the resultant dilute solution directly from the closure. Replacing the closure on the container did not produce any apparent contamination of the liquid concentrate remaining in the container.

Figure 2:
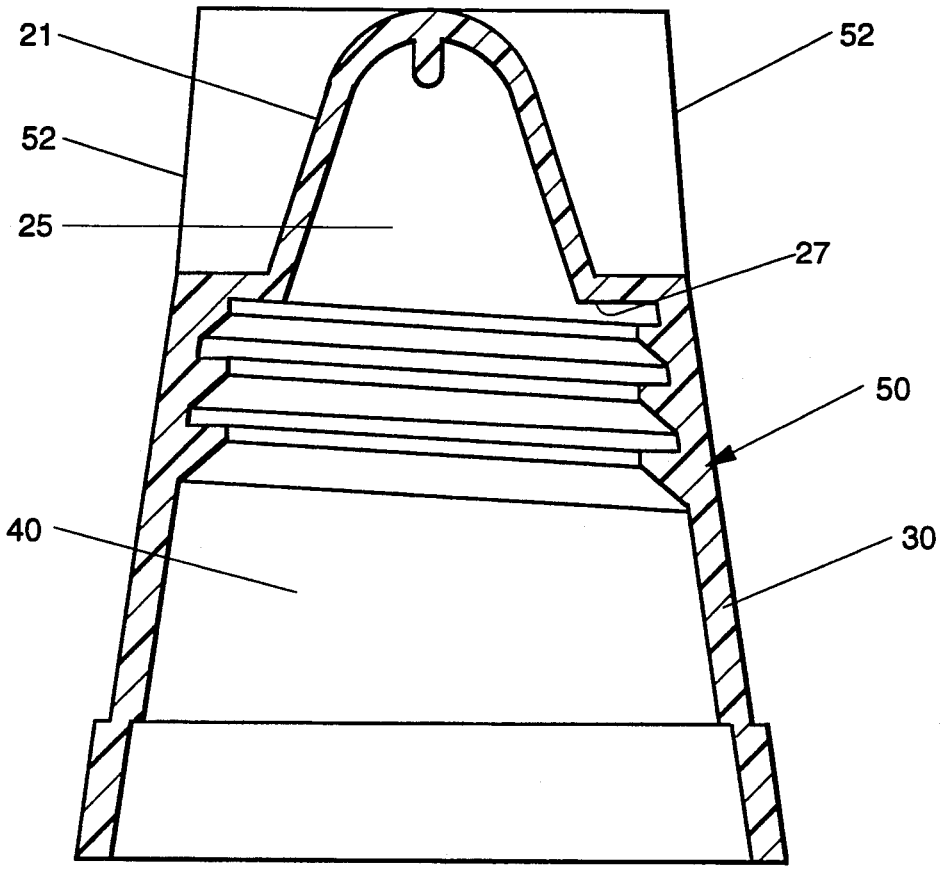
FIG. 2 shows an alternative embodiment of a closure of the present invention in a sectional view.

In FIG. 2 there is shown an alternative embodiment of a closure 50 which is suitable for use in packages of the present invention. Closure embodiment 50 is generally the same as the closure embodiment 20 shown in FIG. 1, except that a plurality of supporting ribs 52 extend radially outwardly from the concentrate reservoir 21, thereby forming a secure, stable footing which allows the closure 50 to be set on a flat surface, such as a countertop, without spilling its contents. In the illustrated closure embodiment 50, four ribs 52 are preferably attached at right angles to each other. It is of course recognized that a stable support can be achieved with as few as three ribs 52, and that it is also possible to employ more than four ribs 52 to achieve such a result.

In the closure embodiment 50 shown in FIG. 2 the concentrate level in the concentrate reservoir 21 is most easily sighted by viewing it where supporting ribs 52 are not present, particularly if the closure embodiment 50 is formed from translucent or transparent material.

Figure 3:
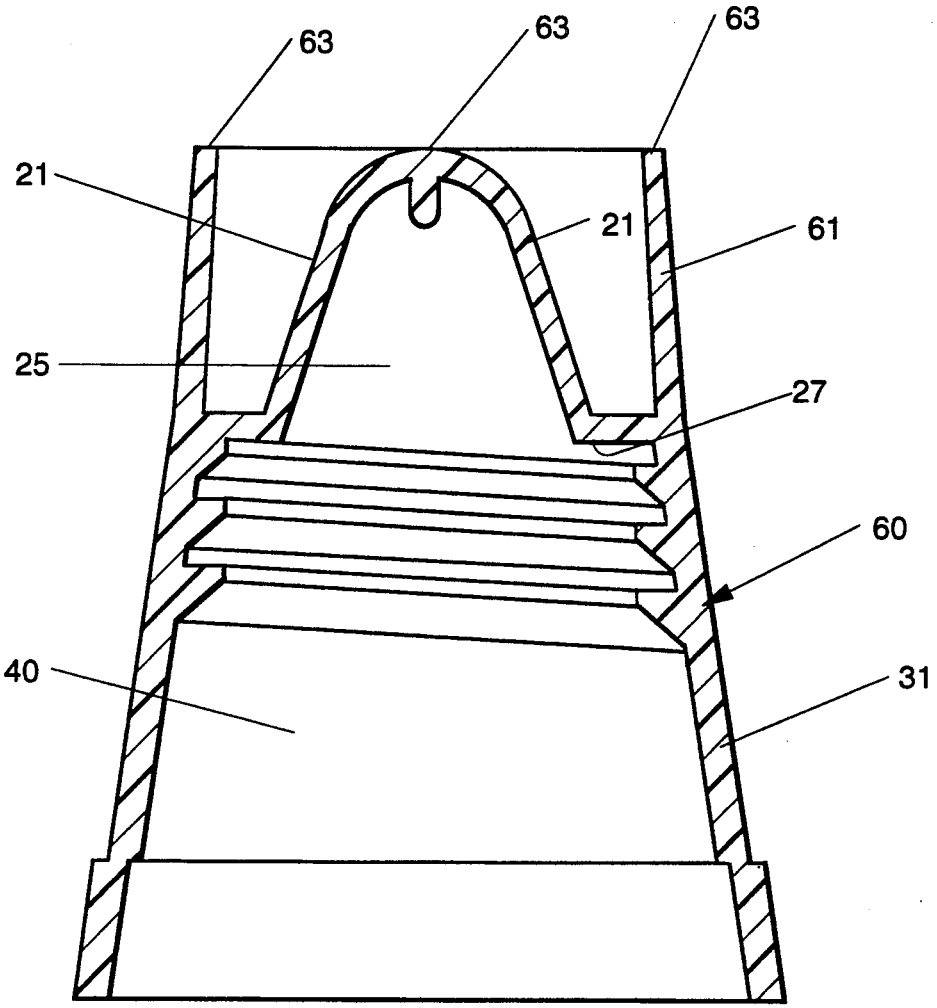
FIG. 3 shows another embodiment of a closure of the present invention in a sectional view.

In FIG. 3 another closure embodiment 60 is shown. Closure embodiment 60 is generally the same as the closure embodiment 20 shown in FIG. 1, except that a concentric cylindrical support ring 61 extends down from the main body portion 30 of the closure 60, enclosing sides of the concentrate reservoir 21. Concentric support ring 61 also forms a secure, stable footing which allows the closure 60 to be set on a flat surface without tipping over. The latter closure embodiment permits labeling to be applied either about support ring 61 or across the bottom 63 of the closure 60 or both.

When injection molded from a transparent material, such as clarified polypropylene, the liquid concentrate level in the concentrate reservoir 21 can be easily sighted through the concentric cylindrical support ring 61.

Figure 4:
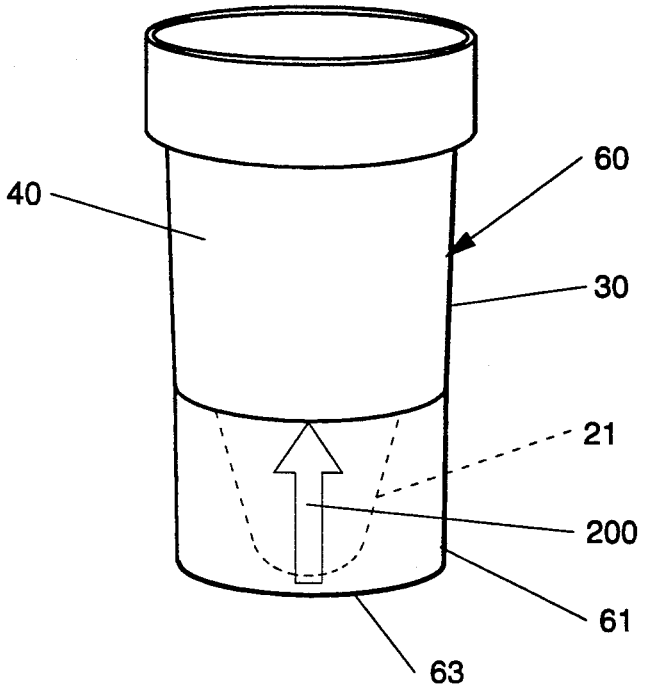
FIG. 4 is a perspective view of the closure embodiment of FIG. 3.

As can best be seen in FIG. 4, the closure embodiment 60 shown in cross-section in FIG. 3, can be provided with one or more external indicators, such as arrows 200, on the concentric cylindrical support ring 61, with the tail(s) of the arrow(s) near the bottom of the closure 60 and the point(s) of the arrow(s) terminating at the desired concentrate fill level.

Figure 5:
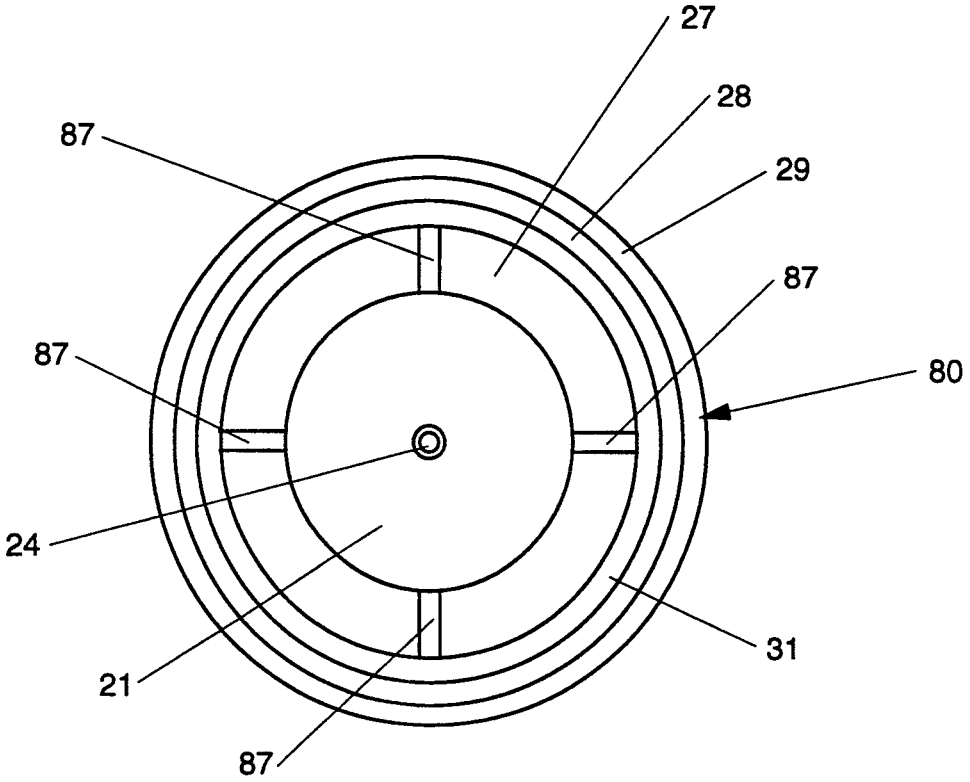
FIG. 5 is an overhead view looking into a closure embodiment of the present invention, said view illustrating optional structure which may be included in the closure to enable the user to easily judge the proper concentrate fill level when viewing the closure from overhead.

In FIG. 5 there is shown an optional structure which may be employed on any of the closure embodiments of the present invention, said view being taken from overhead, looking downwardly into the closure. The closure 80 shown in FIG. 5 may be of a type generally similar to any of those shown in FIGS. 1, 2 or 3.

The optional structure shown in FIG. 5, which can be employed with any of the closure embodiments disclosed herein, comprises a series of four intersecting crosshairs 87, molded or otherwise placed on the uppermost surface of concentrate reservoir shoulder 27. The crosshairs 87 are preferably about 1/32 inch (0.8 millimeters) to 1/16 inch (1.6 millimeters) in height and about 1/32 inch (0.8 millimeters) to 1/16 inch (1.6 millimeters)wide. These crosshairs 87 aid in determining when the correct volume of colored concentrated liquid has been dispensed into the concentrate reservoir 21 when viewing the dispensing operation from overhead. When the crosshairs 87 are hidden by the concentrated liquid being dispensed from container 1, it signals the user that concentrate reservoir 21 has been properly filled and the dispensing operation should cease. Other visual designs, including those which form verbal commands, may, of course, be placed on the concentrate reservoir shoulder 27 to accomplish the same result.

Figure 6:
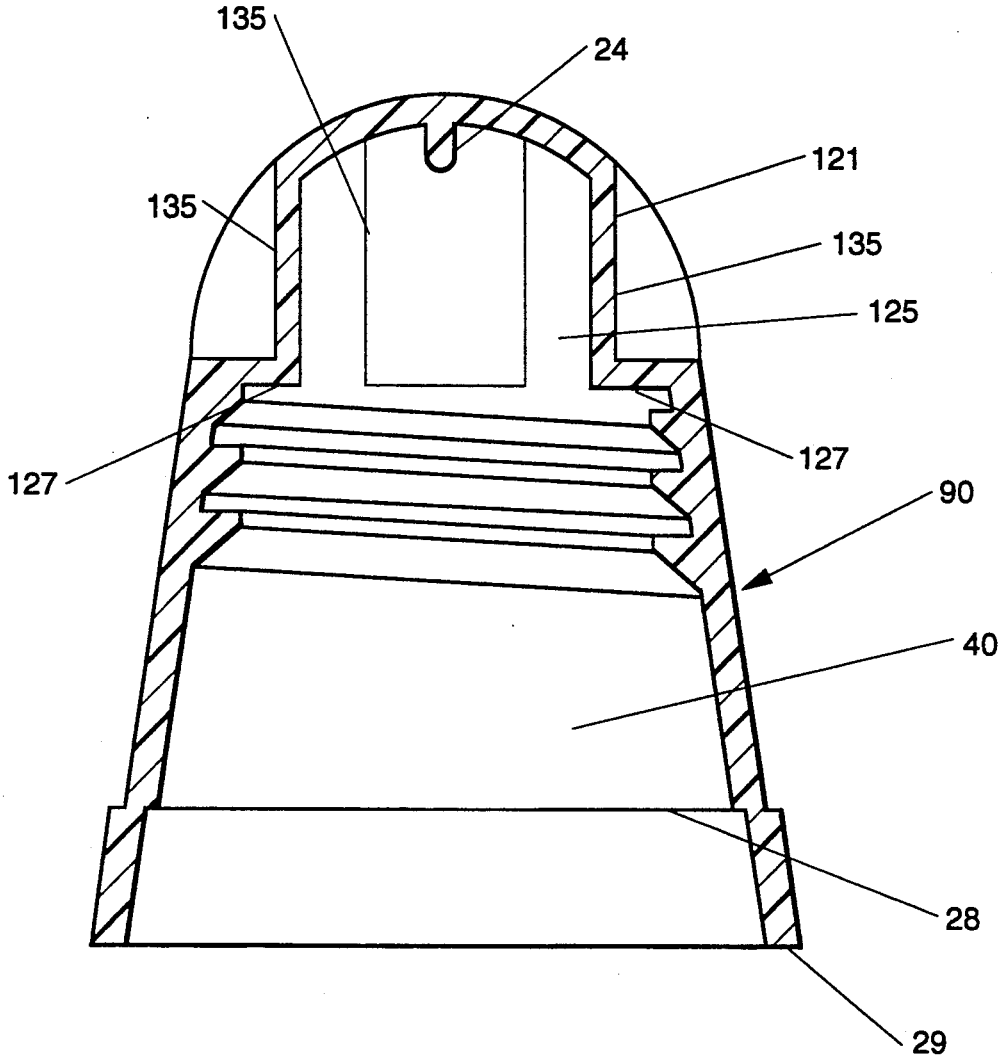
FIG. 6 shows an alternative closure embodiment of the present invention in a sectional view, said closure embodiment exhibiting an alternative configuration for the liquid concentrate reservoir.
Figure 7:
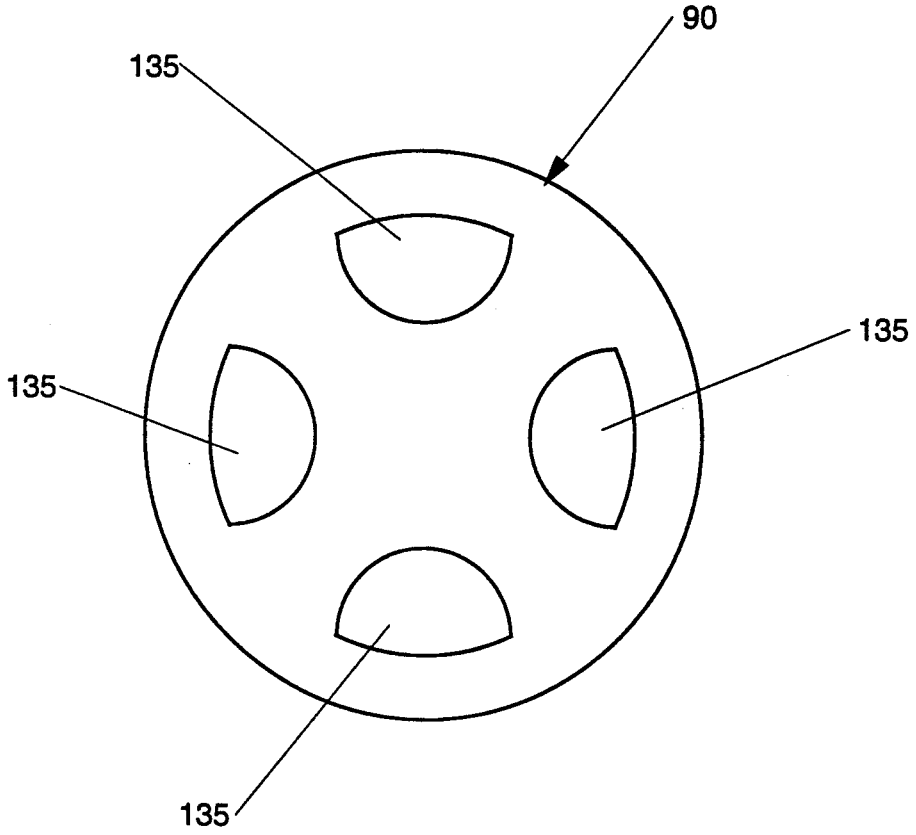
FIG. 7 shows an overhead view of the closure embodiment of FIG. 6.

In the alternative embodiment of the present invention illustrated in FIG. 6, the concentrate reservoir 121 is generally hemispherical in shape but has four cylindrical intrusions 135 into the side of concentrate reservoir 121 so as to reduce the contained volume 125 of concentrate reservoir 121. The reduced volume 125 of concentrate reservoir 121 provides the user of closure 90 with a greater change in vertical height of concentrated liquid measured for a given quantity of the concentrate liquid. The shoulders 127 resulting from the presence of cylindrical intrusions 135 provide a bearing surface for supporting closure 90 on the flange 12 of a complementary spout 11 (not shown).

While particular embodiments of the present invention have been illustrated and described, it would be obvious to those skilled in the art that various changes and modifications can be made without departing form the spirit and scope of the present invention. For example, the cross-section of the closure need not be cylindrical. Furthermore, the closure need not be secured to the container by complementary screw threads. It is intended to cover in the appended claims, all such modifications that are within the scope of this invention.

What is claimed is:

1. A self-contained package for housing, dispensing and diluting to a predetermined concentration level a concentrated liquid housed within said package, said package comprising:

a) a container for housing said concentrated liquid, said container including a discharge orifice and means for releasably securing a closure about the periphery of said discharge orifice;

b) a spout having a first end sealingly secured across said discharge orifice in said container, and a second end exhibiting a discharge orifice of smaller cross-section than the discharge orifice in said container;

c) a closure having a vertical axis and securement means complementary to said securement means on said container for releasably securing said closure about said discharge orifice in said container, said closure further including a concentrate reservoir for receiving a predetermined quantity of said concentrate from said container and a main body portion for receiving a predetermined quantity of dilution liquid after said concentrate reservoir has been filled with said concentrated liquid, said main body portion of said closure having a cross-section, as measured perpendicular to its vertical axis, which is larger than the cross-section of said concentrate reservoir, said closure further including a centrally located post which penetrates said discharge orifice in said spout to form a seal with said discharge orifice in said spout when said closure is fully assembled onto said container; and d) visual indicator means coincident with the uppermost end of said concentrate reservoir to signal the user when the desired predetermined quantity of concentrated liquid has been added thereto.

2. The package of claim 1, further including visual indicator means in said main body portion of said closure to signal the user when the desired predetermined quantity of dilution liquid has been added thereto.

3. The package of claim 1, wherein said closure is comprised of translucent material to permit sighting the level of said concentrated liquid and said dilution liquid through the side of said closure.

4. The package of claim 1, wherein said closure further includes visual indicator means located substantially coincident with the top of said concentrate reservoir, said visual indicator means being submerged by said concentrated liquid as soon as the desired predetermined quantity of concentrated liquid has been dispensed into said closure.

5. A self-contained package for housing, dispensing and diluting to a predetermined concentration level a concentrated liquid housed within said package, said package comprising:

a) a container for housing said concentrated liquid, said container including a discharge orifice and means for releasably securing a closure about the periphery of said discharge orifice;

b) a spout having a first end sealingly secured across said discharge orifice in said container, and a second end exhibiting a discharge orifice of smaller cross-section than the discharge orifice in said container; and c) a closure having a vertical axis and securement means complementary to said securement means on said container for releasably securing said closure about said discharge orifice in said container, said closure further including a concentrate reservoir for receiving a predetermined quantity of said concentrate from said container and a main body portion for receiving a predetermined quantity of dilution liquid after said concentrate reservoir has been filled with said concentrated liquid, said main body portion of said closure having a cross-section, as measured perpendicular to its vertical axis, which is larger than the cross-section of said concentrate reservoir, said closure further including a centrally located post which penetrates said discharge orifice in said spout to form a seal with said discharge orifice in said spout when said closure is fully assembled onto said container, said spout and said closure being comprised of polymeric material which is, at least to a degree, resilient and wherein said sealing post exhibits a taper from its outermost tip to its point of joinder with said closure, whereby said seal between said orifice in said spout and said closure is formed by seating said post against the inside of said discharge orifice in said spout, and wherein said closure member is comprised of transparent material.

6. A self-contained package for housing, dispensing and diluting to a predetermined concentration level a concentrated liquid housed within said package, said package comprising:

a) a resilient deformable container for housing said concentrated liquid, said container including a discharge orifice and means for releasably securing a closure about the periphery of said discharge orifice;

b) a spout having a first end sealingly secured across said discharge orifice in said container, and a second end exhibiting a discharge orifice of smaller cross-section than the discharge orifice in said container;

c) a closure having a vertical axis and securement means complementary to said securement means on said container for releasably securing said closure about said discharge orifice in said container, said closure further including a concentrate reservoir for receiving a predetermined quantity of said concentrate from said container and a main body portion for receiving a predetermined quantity of dilution liquid after said concentrate reservoir has been filled with said concentrated liquid, said main body portion of said closure having a cross-section, as measured perpendicular to its vertical axis, which is larger than the cross-section of said concentrate reservoir, said closure further including a centrally located post which penetrates said discharge orifice in said spout to form a seal with said discharge orifice in said spout when said closure is fully assembled onto said container, and d) visual indicator means coincident with the uppermost end of said concentrate reservoir to signal the user when the desired predetermined quantity of concentrated liquid has been added thereto.

7. The package of claim 6, further including visual indicator means in said main body portion of said closure to signal the user when the desired predetermined quantity of dilution liquid has been added thereto.

8. The package of claim 6, wherein said closure is comprised of translucent material to permit sighting the level of said concentrated liquid and said dilution liquid through the side of said closure.

* * * * *